US007433643B2

(12) United States Patent
Matsuno et al.

(10) Patent No.: US 7,433,643 B2
(45) Date of Patent: Oct. 7, 2008

(54) FIXING DEVICE AND IMAGE FORMING APPARATUS

(75) Inventors: Akinori Matsuno, Osaka (JP); Masuo Kawamoto, Osaka (JP)

(73) Assignee: Kyocera Mita Corporation (JP)

( * ) Notice: Subject to any disclaimer, the term of this patent is extended or adjusted under 35 U.S.C. 154(b) by 234 days.

(21) Appl. No.: 11/504,177

(22) Filed: Aug. 15, 2006

(65) Prior Publication Data

US 2007/0048047 A1 Mar. 1, 2007

(30) Foreign Application Priority Data

Aug. 23, 2005 (JP) ..... 2005-240742
Aug. 23, 2005 (JP) ..... 2005-240743

(51) Int. Cl.
*G03G 15/20* (2006.01)
*G03G 15/00* (2006.01)

(52) U.S. Cl. ..... 399/333; 399/107

(58) Field of Classification Search ..... 384/492; 399/107, 320, 328, 331, 333
See application file for complete search history.

(56) References Cited

U.S. PATENT DOCUMENTS 5,298,957 A * 3/1994 Haupt et al. ..... 399/330
6,276,832 B1 * 8/2001 Wade, III ..... 384/204

FOREIGN PATENT DOCUMENTS

JP 9-325634 12/1997
JP 10-3223 1/1998

* cited by examiner

*Primary Examiner*—Hoang Ngo
(74) *Attorney, Agent, or Firm*—Gerald E. Hespos; Anthony J. Casella

(57) ABSTRACT

A fixing device is provided in image forming apparatuses such as a printer and the like and performs a fixing by heating to a recording sheet on which a toner image is transferred. The fixing device includes: a heating source adapted for performing fixing of a toner image onto a recording medium by heat; a fixing roller including a thin-wall cylinder rotatable about an axis thereof and carrying the heating source therein, the recording medium being placed on a peripheral surface of the cylinder; an annular heat-insulating member coaxially mounted on an outside surface of the fixing roller; and a C-shaped stopper attached to the peripheral surface of the fixing roller for preventing the annular heat-insulating member from moving out of the fixing roller, the C-shaped stopper including at least three engaging portions.

15 Claims, 11 Drawing Sheets

FIXING DEVICE AND IMAGE FORMING APPARATUS

BACKGROUND OF THE INVENTION

1. Field of the Invention

The invention relates to a fixing device for performing fixing of a toner image on a recording medium by heat and an image forming apparatus provided with the same.

2. Description of the Related Art

Generally, an image forming apparatus includes a fixing device. A toner image is formed on a peripheral surface of a photoconductive drum and is transferred to a recording sheet. The fixing device is adapted for fixing the toner image on the recording sheet. The fixing device includes a fixing roller carrying a heater therein. In the state where the fixing roller is heated and rotated, a recording sheet is placed on a peripheral surface of the fixing roller so as to be subjected to a heat processing. Accordingly, fixing of a toner image on the recording sheet is performed.

On each of opposite end portions of the fixing roller of the fixing device, an annular heat-insulating member is coaxially mounted. On each heat-insulating member, a bearing is mounted. Each bearing is supported respectively by opposite side walls facing each other of a predetermined housing. Accordingly, the fixing roller is supported by the housing rotatably about an axis thereof.

Japanese Unexamined Patent Publication No. HEI9-325634 discloses such fixing device as the one described above. The fixing device is provided with a stopper structure employing an annular stopper having a C-shape. The annular stopper is fixedly attached to each end portion of the fixing roller protruding outwardly from a bearing with two holding portions (namely, with two supporting points) formed respectively at end portions of the annular stopper. The annular stopper interferes with a side surface of the bearing so as to prevent the fixing roller from moving out of the bearing.

However, the annular stopper according to the Japanese Unexamined Patent Publication No. HEI9-325634 is attached to a fixing roller with two supporting points so that each stopper is rotatable about an axis connecting the two supporting points. Consequently, an attaching condition of the stopper with respect to the fixing roller is not stabilized, and unsteadiness of the fixing roller is caused. If such unsteadiness of the fixing roller is generated in a thrust direction, it becomes difficult to perform stable fixing of a toner image to the recording sheet. Consequently, a disadvantage such as a defect in a fixed image may be caused.

SUMMARY OF THE INVENTION

An object of the invention is to provide a fixing device which prevents unsteadiness of a fixing roller by attaching a stopper to the fixing roller in a stable condition and providing an image forming apparatus employing the same.

To accomplish the object described above, a fixing device according to an aspect of the invention includes the following construction.

A fixing device comprises: a heating source adapted for performing fixing of a toner image onto a recording medium by heat; a fixing roller including a thin-wall cylinder rotatable about an axis thereof and carrying the heating source therein, the recording medium being placed on a peripheral surface of the cylinder; an annular heat-insulating member coaxially mounted on an outside surface of the fixing roller; and a C-shaped stopper attached to the peripheral surface of the fixing roller for preventing the annular heat-insulating member from moving out of the fixing roller, the C-shaped stopper including at least three engaging portions.

According to this construction, a recording medium is placed on a peripheral surface of the fixing roller rotated about an axis thereof so that the recording medium receives heat from the fixing roller carrying a heating source therein. Consequently, fixing of a toner image is performed. The fixing roller is provided with the C-shaped stopper for preventing the annular heat-insulating member from moving out. The C-shaped stopper is attached to a peripheral surface of the fixing roller with three supporting points. Therefore, as compared to a C-shaped stopper attached to a fixing roller with two supporting points, the C-shaped stopper does not move about a line connecting the supporting points. Thus, an attaching condition of the C-shaped stopper with respect to the fixing roller is stabilized. Consequently, disadvantages that the fixing roller which rotates for performing fixing of a toner image to a recording medium is unstabilized and that stable fixing with respect to the recording medium is not performed can be avoided.

BRIEF DESCRIPTION OF THE DRAWINGS

FIG. 3A is a perspective view showing the state before an annular heat-insulating member, a ring gear, a bearing and a C-shaped stopper are mounted on the fixing roller. FIG. 3B is an enlarged perspective view showing a back side of the fixing roller assembly in the state after the annular heat-insulating member, the ring gear, the bearing and the C-shaped stopper are mounted on the fixing roller.

FIG. 6A shows a state immediately before the C-shaped stopper is attached to the fixing roller. FIG. 6B shows a state where the C-shaped stopper is attached to the fixing roller.

FIG. 7A shows a state immediately before the C-shaped stopper is attached to the fixing roller. FIG. 7B shows a state where the C-shaped stopper is mounted on the fixing roller.

FIG. 8A is a perspective view showing a state before each component is mounted on the fixing roller. FIG. 8B is an enlarged perspective view showing a back side of the fixing roller assembly in the state where each component is mounted on the fixing roller.

FIG. 1A shows a key portion having an inwardly curved surface. FIG. 11B shows a key portion having an outwardly curved surface.

DETAILED DESCRIPTION OF THE PREFERRED EMBODIMENTS

Figure 1:
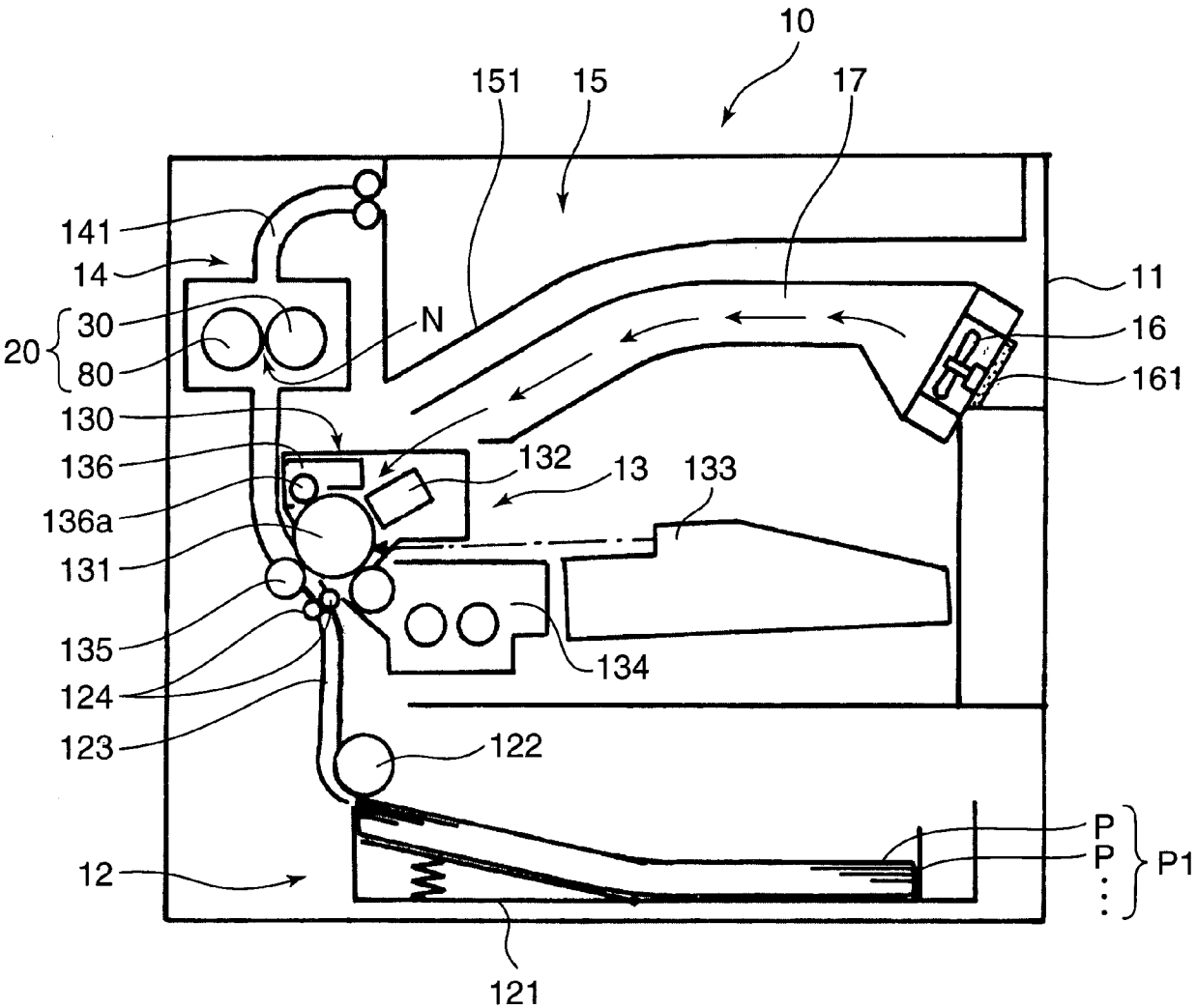
FIG. 1 is a front sectional view showing a schematic internal structure of a printer which is a type of image forming apparatuses adopting a fixing device according to the invention.

FIG. 1 is a front sectional view showing a schematic internal structure of a printer 10 which is a type of image forming apparatuses adopting a fixing device according to the present invention. As shown in FIG. 1, an apparatus main body 11 of the printer (image forming apparatus) 10 includes a sheet storing section 12 for storing a recording sheet (recording medium) P to be printed, an image forming section 13 for performing a transfer of an image to the recording sheet P sent out one after another from a recording sheet stack P1 stored in the recording sheet storing section 12 and a fixing section 14 for performing a fixing of a toner image transferred in the image forming section 13 onto the recording sheet P. Further, a sheet discharging section 15 is provided on a top portion of the apparatus main body 11. The recording sheet P onto which a fixing process is performed in the fixing section is discharged on the sheet discharging portion 15. The sheet discharging section 15 is formed by recessing the top portion of the apparatus main body 11. On a base portion of the recess, a sheet discharging tray 151 is provided for receiving a discharged recording sheet P.

In the sheet storing section 12, a predetermined numbers of recording sheet cassettes 121 are provided detachably with respect to the apparatus main body 11. (Only one recording sheet cassette is provided in the embodiment.) At an upstream end portion (left side in FIG. 1) of the recording sheet cassette 121, a pickup roller 122 for sending out the recording sheets one after another from the recording sheet stack P1 is provided. The recording sheet P sent out from the recording sheet cassette 121 by driving of the pickup roller 122 is fed to the image forming section 13 through a sheet conveyance passage 123 and a registration roller pair 124 provided at a downstream end thereof.

The image forming section 13 performs a transferring process to the recording sheet P based on image information electrically transferred from a computer and the like. The image forming section 13 includes a charging device 132, an exposing device 133, a developing device 134, a transferring roller 135 and a cleaning device 136 provided successively in a clockwise direction from upper right position of a photoconductive drum 131 along a peripheral surface of the photoconductive drum 131 mounted rotatably about an axis extending in a forward and backward directions (in a direction perpendicular to FIG. 1) of the apparatus.

The photoconductive drum 131, the charging device 132 and the cleaning device 136 are provided in a predetermined housing and are unified to constitute a photoconductive unit 130.

An electrostatic latent image and a toner image corresponding to the electrostatic latent image are formed on the photoconductive drum 131. The photoconductive drum 131 includes amorphous silicon layers on a peripheral surface thereof so as to be suited for bearing the latent image.

The charging device 132 uniformly charges the peripheral surface of the photoconductive drum 131 rotated about an axis in a clockwise direction. The charging device 132 charges the peripheral surface of the photoconductive drum by a corona discharge. It should be noted that a charging roller may be adopted in place of the charging device 132.

The exposing device 133 irradiates a laser light ray having a strength modulated based on an image data electrically transferred from an external device such as a computer. The irradiated laser light ray erases an electric charge on the photoconductive drum 131 so as to form the electrostatic latent image on the peripheral surface of the photoconductive drum 131.

The developing device 134 feeds toner particles to the peripheral surface of the photoconductive drum 131. Accordingly, the toner particles are attached to portions of the peripheral surface where the electrostatic latent image is formed. Consequently, a toner image is formed on the photoconductive drum 131.

The transferring roller 135 is adapted for transferring the positively charged toner image formed on the peripheral surface of the photoconductive drum 131 to the recording sheet P conveyed to an immediately leftward position of the photoconductive drum 131. To realize such operation, the transferring roller 135 provides a negative electric charge to the recording sheet P. The negative electric charge provided by the transferring roller 135 is a reversed polarity with respect to the electric charge of the toner image. Thus, the recording sheet P conveyed to an immediately downward position of the photoconductive drum 131 is pressingly nipped between the transferring roller 135 and the photoconductive drum 131. At the same time, the recording sheet is negatively charged so that the positively charged toner image formed on the peripheral surface of the photoconductive drum 131 is peeled off and transferred to the recording sheet P. Consequently, the transferring process is performed to the recording sheet P.

The cleaning device 136 removes and cleans up toner particles resided on the peripheral surface of the photoconductive drum 131 after the transferring process and stuffs spattered and attached to the peripheral surface of the photoconductive drum 131 when extraneous substances such as powder dusts attached to a charging wire in the charging device 132 are cleaned. In the cleaning device 136, a scraping roller 136*a* which scrapes the peripheral surface of the photoconductive drum 131 is provided. The scraping roller 136*a* rotates and scrapes off the toner particles and extraneous substances attached on the peripheral surface of the photoconductive drum 131. (Namely, the peripheral surface of the photoconductive drum 131 is ground) A portion of the peripheral surface of the photoconductive drum 131 cleaned up by the cleaning device 136 moves to the charging device 132 again for the next image forming process.

The fixing section 14 is adapted for performing fixing of a toner image transferred to the recording sheet P in the image forming section by heat and includes a fixing device 20. The fixing device 20 has a fixing roller 30 for applying heat to the recording sheet P and a pressing roller 80 facingly provided at the left side of the fixing roller 30.

After the transferring process is performed, the recording sheet P is sent to a nipping portion N formed between the fixing roller 30 and the pressing roller 80. The recording sheet P passes through the nipping portion N and receives heat from the fixing roller 30. Accordingly, fixing of a toner image is performed. After fixing is performed, the recording sheet P is discharged onto the recording sheet discharging portion 15 through the recording sheet conveyance passage 141.

Further the printer 10 includes an air blower 16 and an air duct 17. The air blower 16 has a filter 161 for taking an outer air into the apparatus main body 11 at an upper right position in FIG. 1. The air duct 17 guides an outer air taken in through the filter 161 by the air blower 16 to the photoconductive unit 130. An outer air is blown toward the photoconductive unit 130 through the air duct 17 by driving of the air blower 16.

The outer air passes through an inner portion of the photoconductive unit 130 and cools down the inner portion of the photoconductive unit 130 in the case where the inner portion of the photoconductive unit 130 is excessively heated by an unillustrated heater provided in the photoconductive drum 131.

Figure 2:
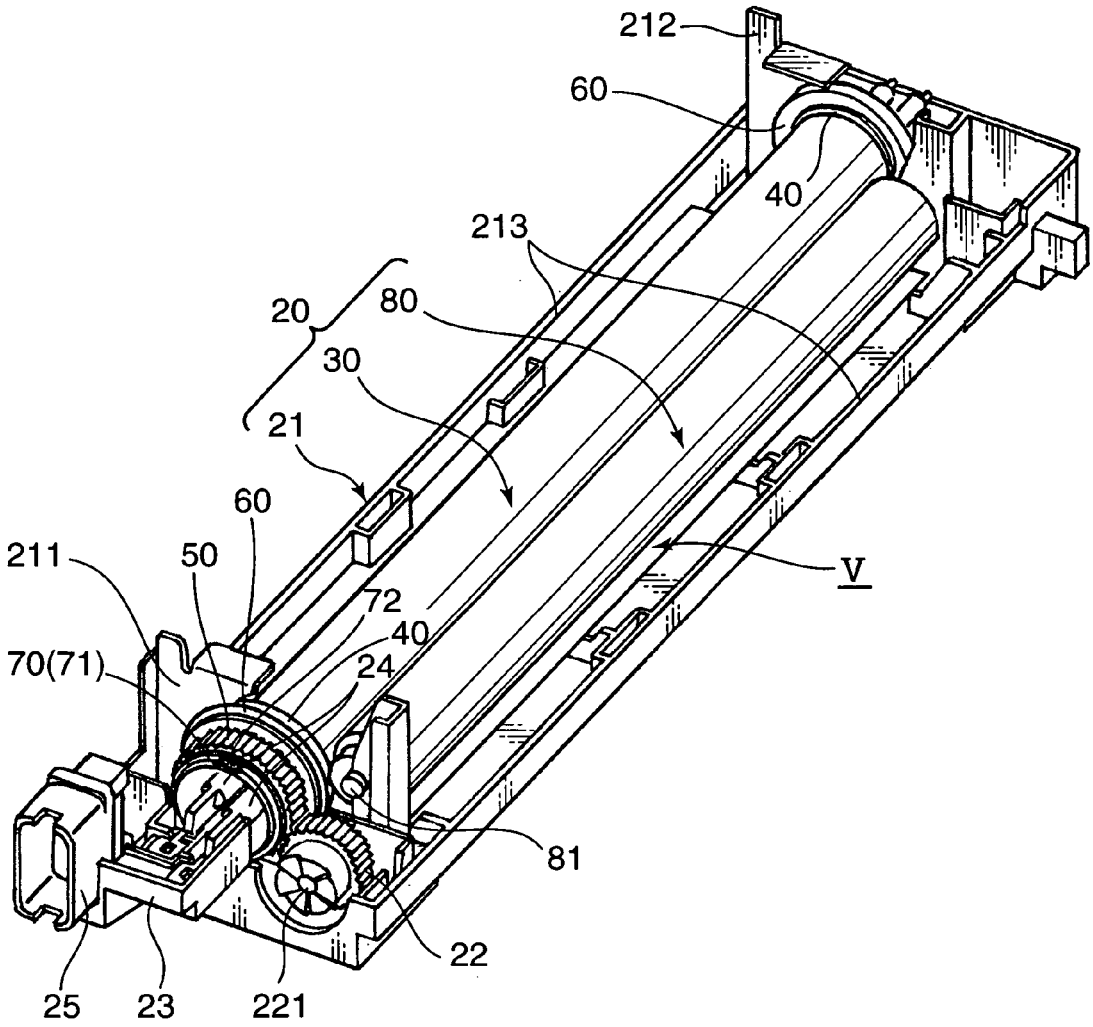
FIG. 2 is a perspective view showing an embodiment of the fixing device viewed from a back side.

FIG. 2 is a perspective view showing an embodiment of the fixing device viewed from a back side. In FIG. 2, a positional relationship of left and right hand is reversed as compared to the fixing device 20 shown in FIG. 1. (Namely, in FIG. 1, the fixing roller 30 is positioned at the right side and the pressing roller 80 is positioned at the left side. However, in FIG. 2, the fixing roller 30 is positioned at the left side and the pressing roller 80 is positioned at the right side.)

As shown in FIG. 2, the fixing device 20 includes a casing 21, and the fixing roller 30 and the pressing roller 80 are aligningly mounted at the left and right sides in the casing 21. The casing 21 includes a back surface plate 211, a front surface plate 212 and a pair of side plate members 213. The back surface plate 211 is provided at a near side in FIG. 2. The front surface plate 212 is provided at a far side in FIG. 2. The pair of side plate members 213 are provided between opposite side edges of the back surface plate 211 and the front surface plate 212. In a space surrounded by the back surface plate 211, the front surface plate 212 and the side plate members 213, a mounting space V for mounting the fixing roller 30 and the pressing roller 80 is formed.

In the mounting space V, the fixing roller 30 is mounted between the back surface plate 211 and the front surface plate 212 at a left side position in FIG. 2. Further, the pressing roller 80 is mounted at a right side of the fixing roller 30 in the state where the peripheral surface of the pressing roller 80 comes in contact with the peripheral surface of the fixing roller 30.

At each end portion of the fixing roller 30, a bearing 60 is mounted through an annular heat-insulating member 40 described hereinafter. The bearings 60 are placed respectively in recessed portions formed on the back surface plate 211 and the front surface plate 212. Consequently, the fixing roller 30 is disposed rotatably about an axis in the mounting space V of the casing 21. The pressing roller 80 is axially supported by a roller shaft 81 disposed between the back surface plate 211 and the front surface plate 212 at a right side position of the fixing roller 30 in the mounting space V in FIG. 2. Consequently, the pressing roller 80 is driven by rotations of the fixing roller 30 and rotated about the roller shaft 81.

Further, an ring gear 50 described hereinafter is integrally and rotatably placed on an end portion of the fixing roller 30 at a side nearer than the bearing 60 in FIG. 2. On the other hand, on the back surface plate 211, a driving gear 22 rotated about the gear shaft 221 by driving of an unillustrated driving motor is provided. The driving gear 22 is engaged with the ring gear 50 so that rotations of the driving gear 22 driven by driving of the driving motor is transmitted to the fixing roller 30 through the ring gear 50.

On the back surface plate 211, a terminal block 23 is provided so as to face an end opening of the fixing roller 30. In a state of being mounted extendingly from the terminal block 23 toward an inner part of the fixing roller 30, a heat generating body 24 (a heating source) consisting of a halogen lamp and the like is provided. A size of the heat generating body 24 is set so as to avoid the heat generating body 24 from coming in contact with an inner surface of the fixing roller 30. An electric power is supplied from an unillustrated power source to the heat generating body 24 through a connector 25 and the terminal block 23 so that the heat generating body 24 generates heat. Consequently, the fixing roller 30 is heated.

First embodiment of a fixing roller assembly

Figures 3A, 3B:
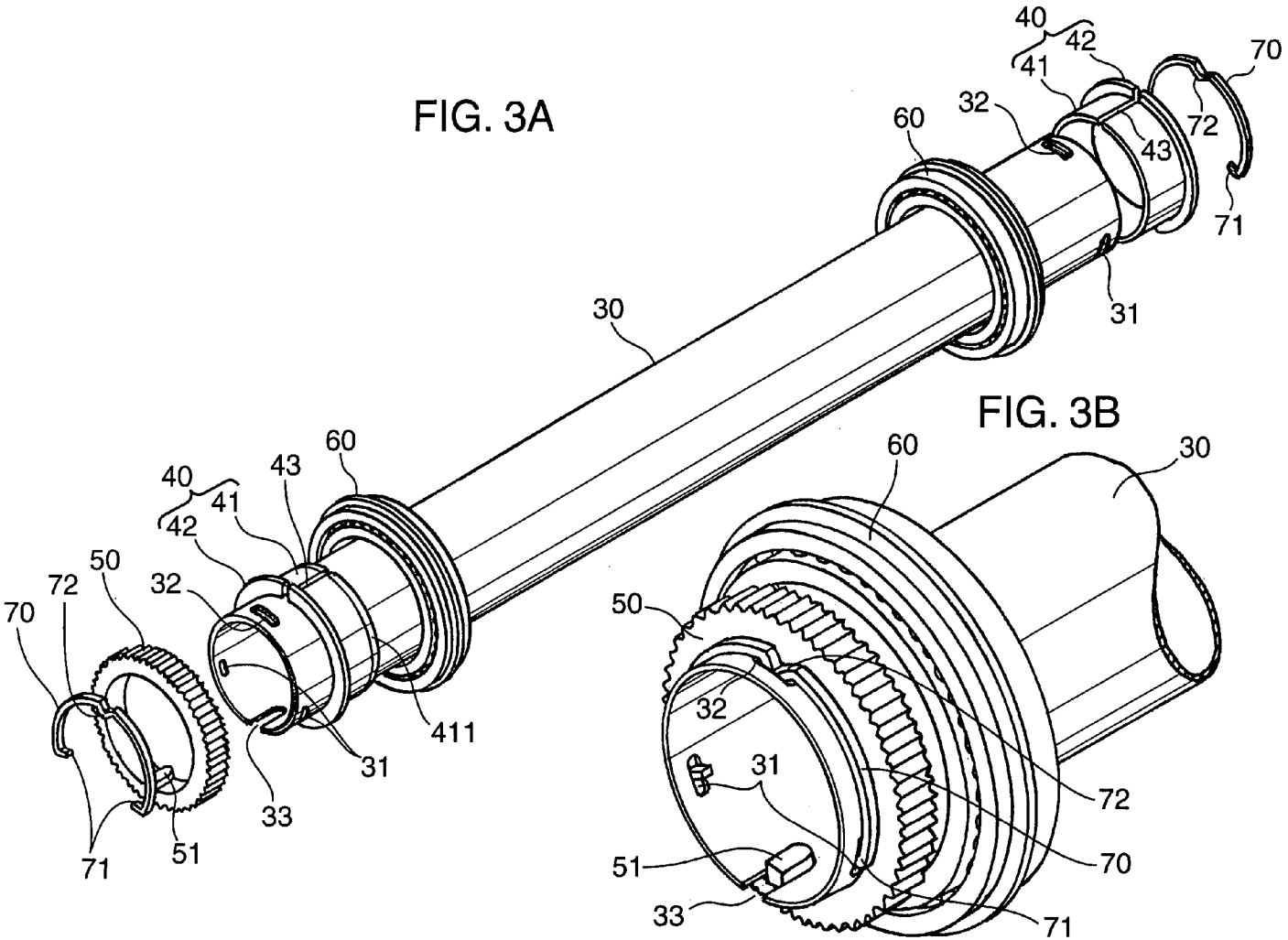
FIGS. 3A and 3B are views for describing a first embodiment of a fixing roller assembly.
Figure 4:
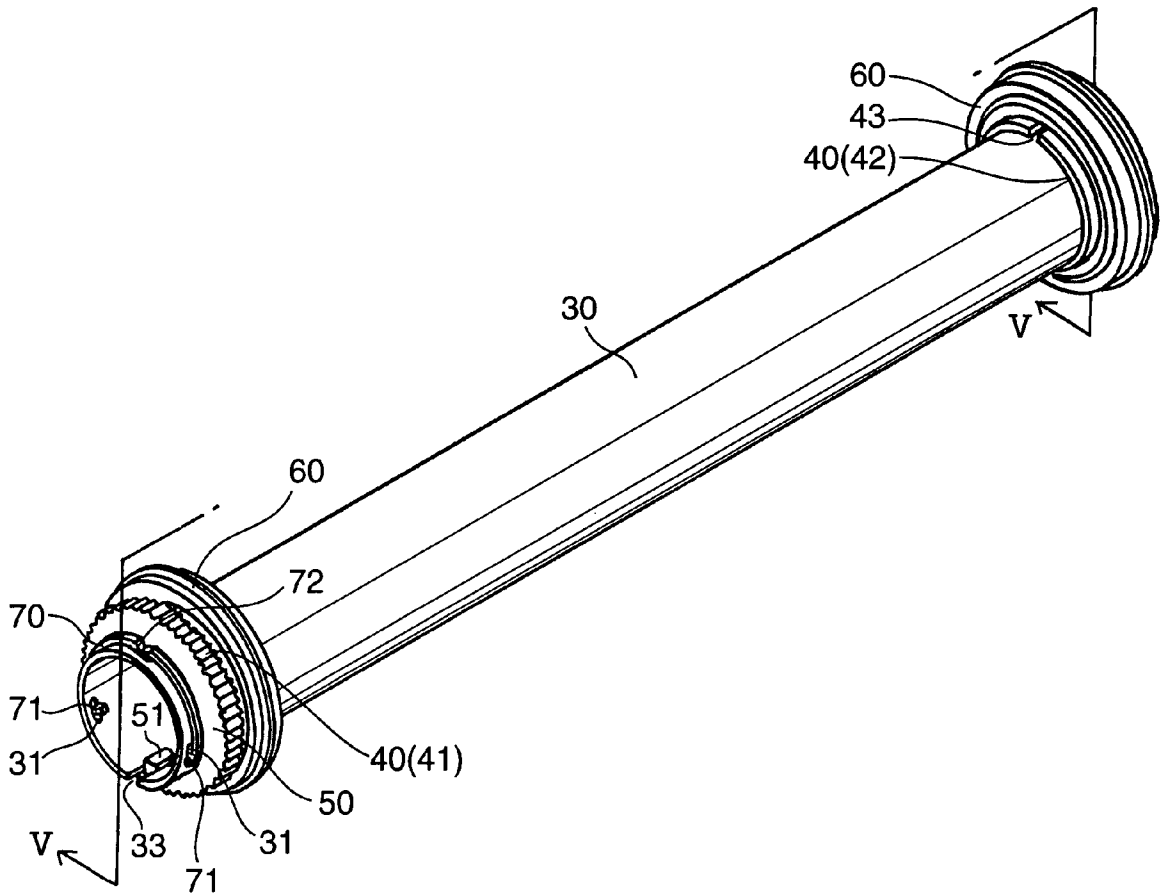
FIG. 4 is an overall perspective view showing the fixing roller assembly according to the first embodiment in the state where each component is assembled.
Figure 5:
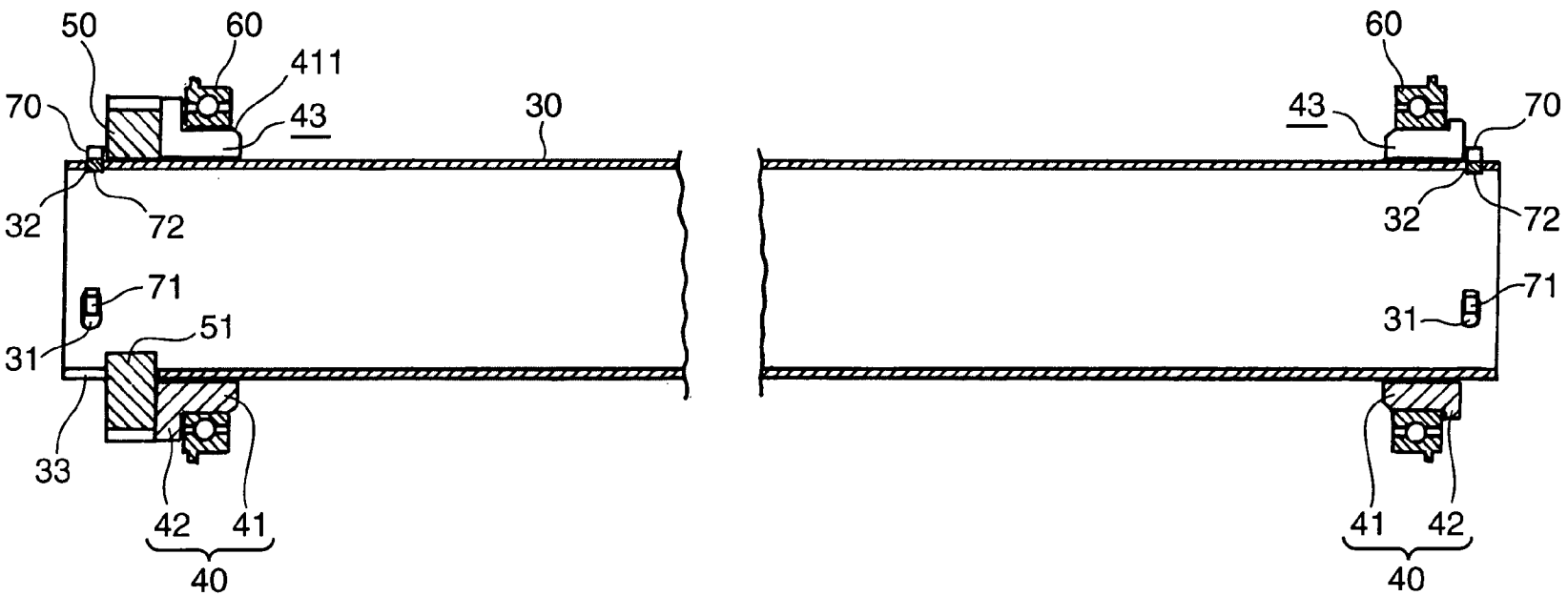
FIG. 5 is a sectional view of FIG. 4 taken along a V-V line.

FIGS. 3A and 3B are views for describing a first embodiment of a fixing roller assembly. FIG. 3A is a perspective view showing the state before the annular heat-insulating member 40, the ring gear 50, the bearing 60 and a C-shaped stopper 70 are mounted on the fixing roller 30. FIG. 3B is an enlarged perspective view showing a back surface side of the fixing roller assembly in the state where the annular heat-insulating member 40, the ring gear 50, the bearing 60 and the C-shaped stopper 70 are mounted on the fixing roller 30. FIG. 4 is an overall perspective view showing the fixing roller assembly according to the first embodiment in the state where each components are assembled. FIG. 5 is a sectional view of FIG. 4 taken along a V-V line.

As shown in these figures, the fixing roller assembly is assembled by mounting the annular heat-insulating member 40, the ring gear 50, the bearing 60 and the C-shaped stopper 70 on one end portion of the fixing roller 30 and mounting the annular heat-insulating member 40, the bearing 60 and the C-shaped stopper 70 on the other end portion.

As shown in FIG. 3A, the fixing roller 30 is a cylindrical body having a thin-wall made of a metal. In the first embodiment, an external diameter of the fixing roller 30 is set to be 31.4 mm, and a thickness is set to be 0.35 mm. According to such configuration, a heating process performed by the heat generating body 24 against the fixing roller 30 is executed expeditiously, and a booting operation of the fixing device 20 performed when a power switch of the printer 10 is turned on is executed expeditiously.

At each of opposite end portions of the fixing roller 30, a pair of first engaging holes 31 and a second engaging hole 32 are formed. The first engaging holes 31 are adapted for engaging the opposite end portions of the C-shaped stopper 70, and the second engaging hole 32 is adapted for engaging an intermediate portion of the C-shaped stopper 70. In the embodiment, a center angle between the first engaging holes is set to be substantially 120 degrees, and a center angle between the second engaging hole and each first engaging hole is also set to be substantially 120 degrees. According to these angle settings, the first and second engaging holes 31, 32 are formed at substantially the even pitches in a peripheral direction of the fixing roller 30.

Further, at a proper portion of an end edge portion in the near side of the fixing roller 30 in FIG. 3A (a point-symmetric position with respect to the second engaging hole 32 in the embodiment), a retaining slit 33 is formed by cutting the end edge toward a longitudinal direction at a predetermined length. A part of the ring gear 50 is retained by the retaining slit 33 so that the ring gear 50 is mounted on the fixing roller 30 in a state of being retained from rotating against the fixing roller 30. It should be noted that the retaining slit 33 is not formed at an end portion of the far side in FIG. 3A of the fixing roller 30 since the ring gear 50 is not needed to be attached.

On a near side portion of the fixing roller 30 in FIG. 2, the annular heat-insulating member 40, the ring gear 50, the bearing 60 and the C-shaped stopper 70 are placed. On the other hand, on a far side portion of the fixing roller 30 in FIG. 2, the annular heat-insulating member 40, the bearing 60 and the C-shaped stopper 70 are placed (refer to FIG. 5).

On a near side portion of the fixing roller 30 in FIG. 3A, the bearing 60 is loosely placed on the fixing roller 30 at first. Continuously, the annular heat-insulating member 40 is coaxially mounted on the fixing roller 30. After then, the bearing 60 is placed on the annular heat-insulating member 40. After the ring gear 50 is mounted on the fixing roller 30 in this state, the C-shaped stopper 70 is attached to the fixing roller 30. On the other hand, on a far side portion of the fixing roller 30 in FIG. 3A, the annular heat-insulating member 40 is mounted on the fixing roller 30 in the state where the bearing 60 is freely placed on the fixing roller 30.

The annular heat-insulating member 40 has a basic configuration including a heat-insulating member main body 41 and a flange 42 formed coaxially with one end portion of the heat insulating member main body 41. The annular heat-insulating member 40 is placed on the fixing roller 30 from a side of the heat-insulating member main body 41. In the embodiment, a slit 43 is formed on the annular heat-insulating member 40 by cutting a part of the annular heat-insulating member 40 in a longitudinal direction of the cylinder. An operation for placing the annular heat-insulating member 40 to the fixing roller 30 is performed by elastically deforming the annular heat-insulating member 40 so as to widen a gap of the slit 43. Thus, since the annular heat-insulating member 40 is curled around the fixing roller 30 by elasticity in the state of being placed on the fixing roller 30, a mounting condition of the annular heat-insulating member 40 with respect to the fixing roller 30 is stabilized.

Further, on an end edge of the heat-insulating member main body 41 opposite from the side where the flange 42 is provided, an annular tapered portion 411 slantingly oriented in an outward direction from the peripheral surface to an axis is formed. The bearing 60 is guided to the annular tapered portion 411 so as to be easily placed on the heat-insulating member main body 41.

An inner diameter of the ring gear 50 is set to be slightly larger than an external diameter of the fixing roller 30. Accordingly, the ring gear 50 is slidely placed on the fixing roller 30. In an inner surface of the ring gear 50, as shown in FIG. 3A, a retaining projection 51 corresponding to the retaining slit 33 of the fixing roller 30 is provided extendingly toward a cylindrical center of the fixing roller 30. The ring gear 50 is inserted into the fixing roller 30 in the state where the retaining projection 51 corresponds to the retaining slit 33 of the fixing roller 30. Consequently, the fixing roller 50 is mounted on the fixing roller 30 in the state being retained from rotating against the fixing roller 30.

The bearing 60 is supported by the back surface plate 211 and the front surface plate 212 of the casing 21 (FIG. 2) in the state where the bearing 60 is axially supported rotatably about the cylindrical center of the fixing roller 30 through the annular heat-insulating member 40. An inner diameter of the bearing 60 is set to be substantially the same as an outer diameter of the heat-insulating member main body 41. The annular heat-insulating member 40 is pressingly inserted into the bearing 60 in the state where the ring gear 50 is placed on the fixing roller 30 through the annular heat-insulating member 40.

The C-shaped stopper 70 is adapted for preventing the annular heat-insulating member 40 on which the bearing 60 is placed from moving out. The C-shaped stopper 70 is formed to have a shape of an arc having a curvature center angle of substantially 240 degrees. An inner diameter of the C-shaped stopper 70 is set to be slightly smaller than an outer diameter of the fixing roller 30.

The C-shaped stopper 70 is formed by curving a wire member into a C-shape and bending parts of the wire member so as to have three engaging portions and is attached to the fixing roller 30. Namely, the C-shaped stopper 70 includes a pair of end engaging portions (engaging portions) 71 protruding from opposite ends of the C-shaped stopper 70 and facing each other in the opposite directions (formed by bending opposite end portions toward a curvature center in the present embodiment) and an intermediate engaging portion (engaging portion) 72 protruding inwardly from substantially an intermediate part of the C-shaped stopper 70 (formed by bending an intermediate part toward a curvature center to have a V-shape).

Positions of the pair of end engaging portions 71 are set so as to correspond to a pair of first engaging holes 31 of the fixing roller 30. A position of the intermediate engaging portion 72 is set so as to correspond to a second engaging hole 32 of the fixing roller 30. In the state where the annular heat-insulating member 40 and the bearing 60 are placed on the fixing roller 30 and the ring gear 50 is mounted on the fixing roller 30 at a position slightly inner part than the first and second engaging holes 31, 32, the pair of the end engaging portions 71 are inserted into the pair of the first engaging holes 31 of the fixing roller 30 from outside, and the intermediate engaging portion 72 is further inserted into the second engaging hole 32 of the fixing roller 30 from outside. Consequently, the C-shaped stopper 70 is placed on the fixing roller 30 with three supporting points as shown in FIG. 3B. Such way of mounting the C-shaped stopper 70 prevents the ring gear 50, the annular heat-insulating member 40 and the bearing 60 from moving out.

In the state where the fixing roller 30 on which the annular heat-insulating member 40, the ring gear 50, the bearing 60 and the C-shaped stopper 70 are mounted is mounted in the casing 21 through the bearing 60 as shown in FIG. 2, if the driving gear 22 is drivingly rotated by driving of an unillustrated driving motor, the ring gear 50 which engages with the driving gear 22 is rotated. Consequently, the fixing roller 30 is also rotated.

In the fixing roller assembly according to the first embodiment, a pair of the first engaging holes 31 and the second engaging hole 32 are formed on the fixing roller 30, and end engaging portions 71 corresponding to a pair of the first engaging holes 31 and the intermediate engaging portion 72 corresponding to the second engaging hole 32 are formed on the C-shaped stopper 70. The end engaging portions 71 and the intermediate engaging portion 72 are placed respectively into the first engaging holes 31 and the second engaging holes 32. Accordingly, the C-shaped stopper 70 is mounted with three supporting points. Consequently, a mounting condition of the C-shamed stopper 70 with respect to the fixing roller 30 is stabilized.

Figure 6A:
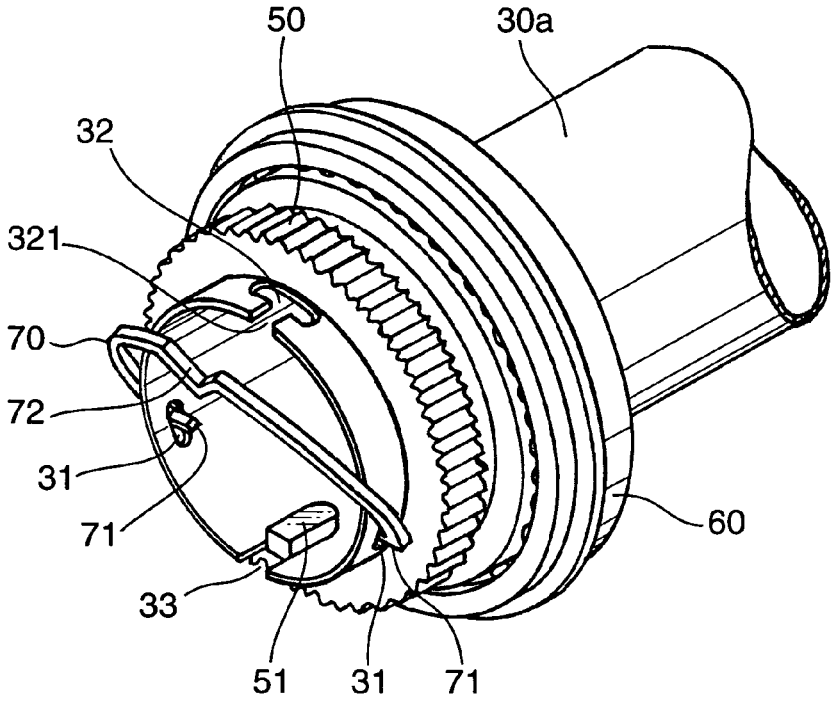
FIGS. 6A and 6B are perspective views showing a back side end portion of the fixing roller assembly according to a second embodiment.
Figure 6B:
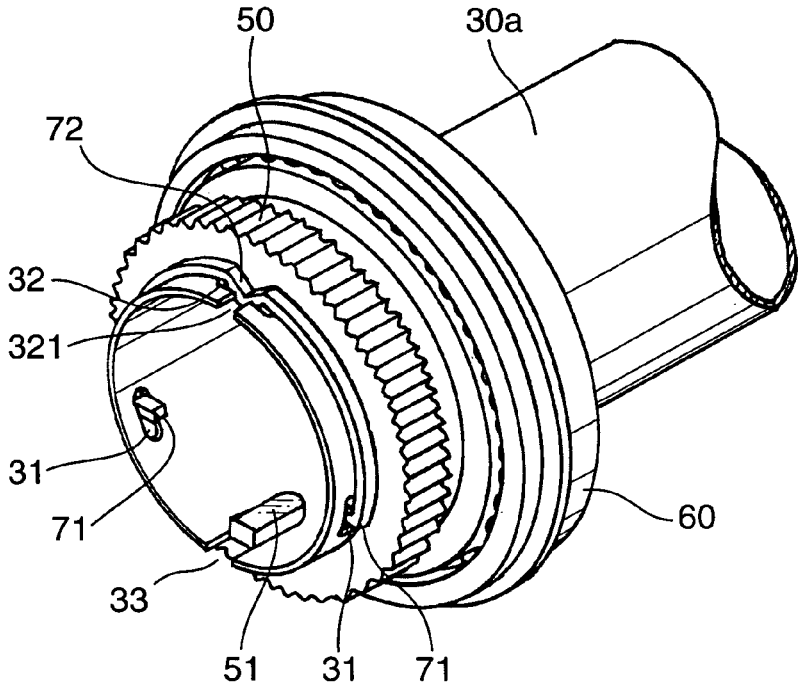

Further, on the fixing roller 30, only the three engaging holes (a pair of the first engaging holes 32 and the second engaging hole 32) for mounting the C-shamed stopper 70 and the engaging slit 33 for mounting the ring gear 50 are formed. Therefore, even if the fixing roller 30 has a thin wall, the fixing roller 30 can be accommodated. Second embodiment of a fixing roller assembly FIGS. 6A, 6B are perspective views of a back side end portion showing a fixing roller assembly according to a second embodiment. FIG. 6A shows a state immediately before the C-shaped stopper 70 is attached to the fixing roller 30*a*. FIG. 6B shows a state where the C-shaped stopper 70 is attached to the fixing roller 30*a*.

As shown in FIGS. 6A, 6B, a fixing roller 30*a* used in the second embodiment is formed with a slit 321 extending from the second engaging hole 32 to an edge of the fixing roller 30*a*. The slit 321 is formed at an intermediate position in a peripheral direction of the second engaging hole 32. A base end side of the constricted slit 321 communicates with the second engaging hole 32, and an end edge side is formed to be an open end being open toward outer side. The slit 321 is formed to have a width smaller than the second engaging hole 32 in a peripheral direction. Accordingly, the second engaging hole 32 has a shape of what is called a dovetail groove.

Other constructions of the fixing roller 30*a* are same as those of the fixing roller 30 according to the first embodiment.

According to the fixing roller 30*a* used in the second embodiment, a pair of end engaging portions 71 are placed in a corresponding pair of the first engaging holes 31 at first when the C-shaped stopper 70 is mounted on the fixing roller 30*a*. Consequently, as shown in FIG. 6A, the C-shaped stopper 70 becomes rotatable about a pair of end engaging portions 71. In this state, the C-shaped stopper 70 is rotated about the end engaging portions 71 in a clockwise direction. Continuously, the C-shaped stopper 70 is elastically deformed so that the intermediate engaging portion 72 having a V-shape is narrowed and passed through the slit 321. Consequently, the intermediate engaging portion 72 is fitted in the second engaging hole 32, and the C-shaped stopper 70 is attached to the fixing roller 30*a* as shown in FIG. 6B.

Figure 7A:
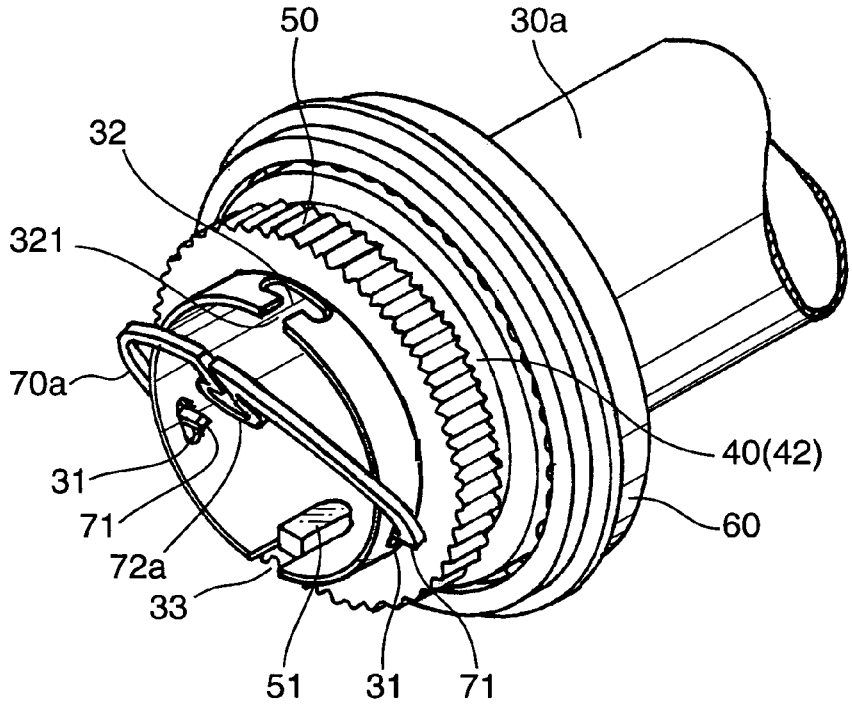
FIGS. 7A and 7B are perspective views showing a back side end portion of the fixing roller assembly according to the third embodiment.
Figure 7B:
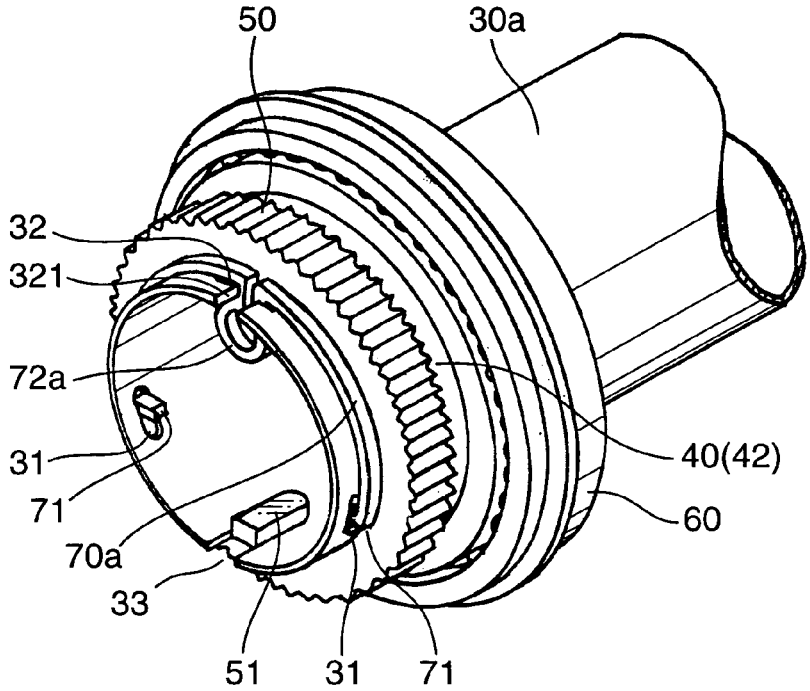

As can be seen, by providing the slit 321 to the second engaging hole 32, a mounting operation of the C-shaped stopper to the fixing roller 30*a* becomes easy. Third embodiment of a fixing roller assembly FIGS. 7A, 7B are perspective views of a back end portion showing the third embodiment of the fixing roller assembly. FIG. 7A shows a state immediately before the C-shaped stopper 70*a* is attached to the fixing roller 30*a*. FIG. 7B shows a state where the C-shaped stopper 70*a* is attached to the fixing roller 30*a*.

As shown in FIGS. 7A, 7B, the c-shaped stopper 70*a* used in the third embodiment includes an intermediate engaging portion 72*a* having an inverted Ω-shape in place of the intermediate engaging portion 72 having a V-shape according to the second embodiment. Other constructions of the C-shaped stopper 70*a* are the same as those of the second embodiment. The C-shaped stopper 70*a* is applied only for the fixing roller 30*a* having the slit 321.

Figures 8A, 8B:
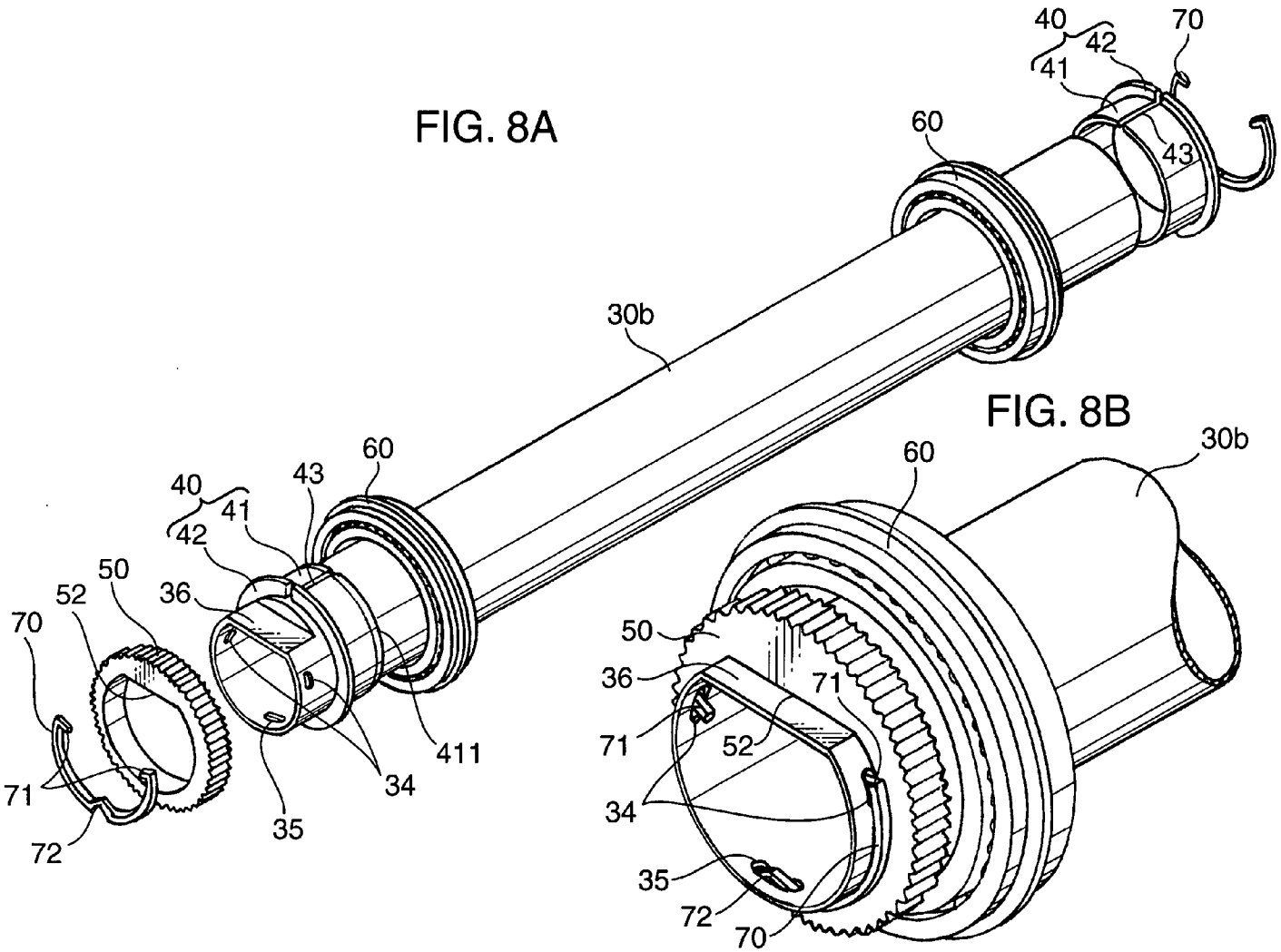
FIGS. 8A and 8B are views for describing a fixing roller assembly according to the fourth embodiment.
Figure 9:
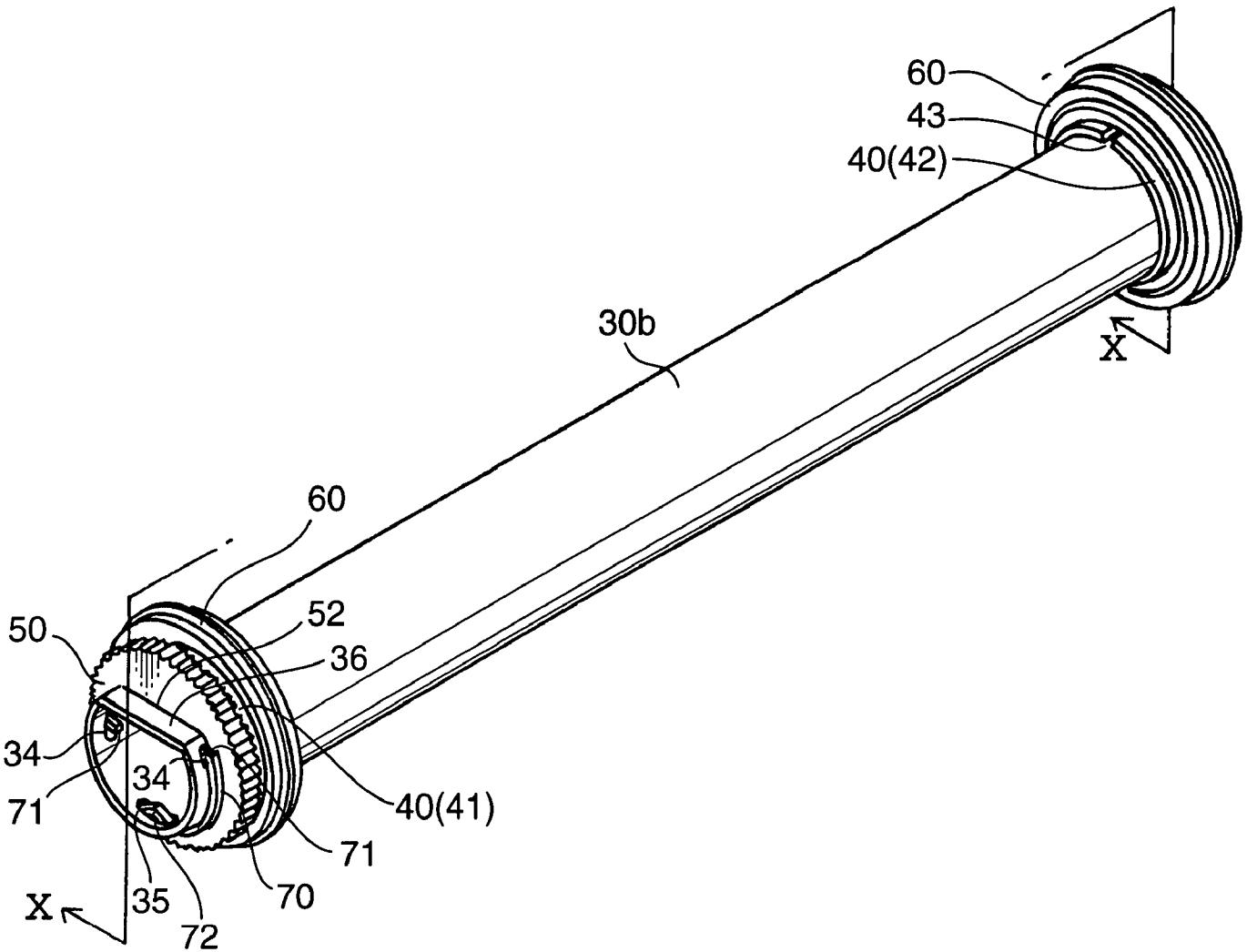
FIG. 9 is an overall perspective view of the fixing roller assembly according to the fourth embodiment showing the state where all of the components are assembled.
Figure 10:
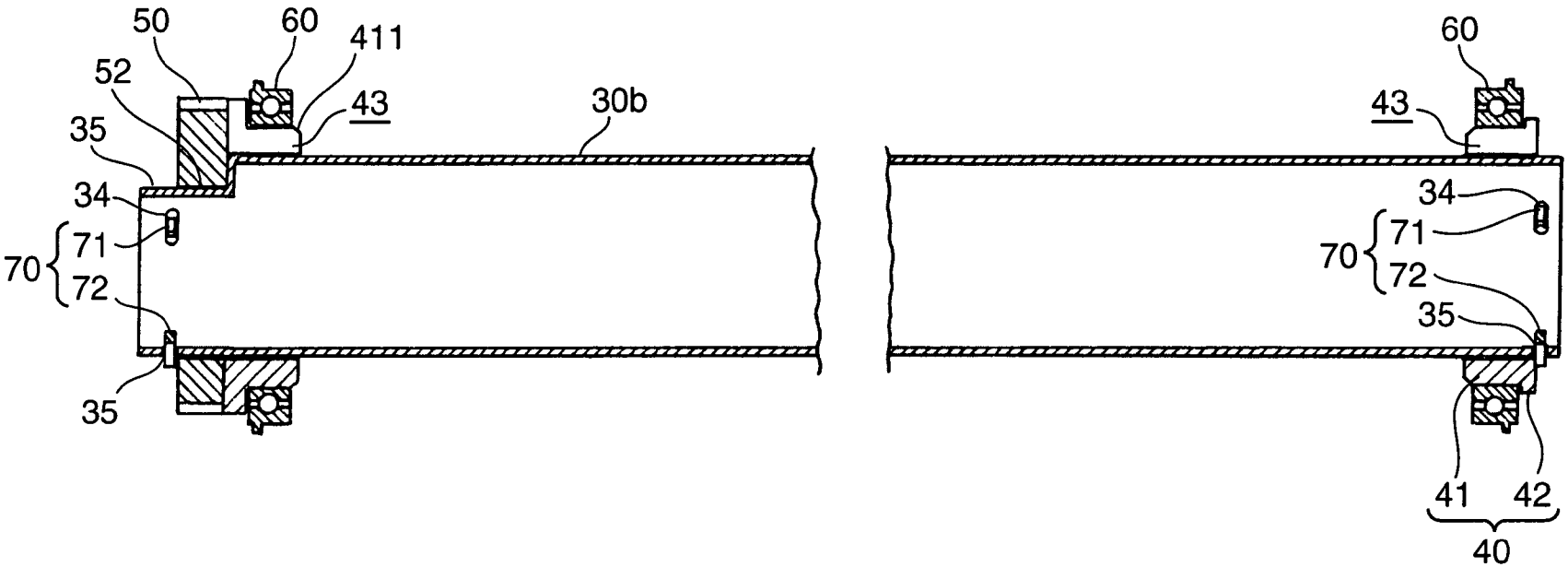
FIG. 10 is a sectional view of FIG. 9 taken along an X-X line.

When the C-shaped stopper 70*a* used in the third embodiment is attached to the fixing roller 30*a*, a pair of the end engaging portions 71 are placed in the corresponding first engaging holes 31 of the fixing roller 30*a* from an outer side. Accordingly, the C-shaped stopper 70*a* becomes rotatable about a pair of the end engaging portions 71. In this state, the C-shaped stopper 70*a* is rotated about the end engaging portions 71 in a clockwise direction. Continuously, the C-shaped stopper 70*a* is elastically deformed so that the constricted portion of the intermediate engaging portion 72*a* having a shape of an inverted Ω is narrowed and passed through the constricted slit 321. Accordingly, the intermediate engaging portion 72*a* is placed in the second engaging hole 32. Consequently, the C-shaped stopper 70*a* is attached to the fixing roller 30*a* as shown in FIG. 7B. Fourth embodiment of a fixing roller assembly FIGS. 8A, 8B are views for describing a fixing roller assembly according to the fourth embodiment. FIG. 8A is a perspective view showing a state before each component is mounted on the fixing roller 30*b*. FIG. 8B is an enlarged perspective view of a back side of the fixing roller assembly showing the state where each component is mounted on the fixing roller 30*b*. FIG. 9 is an overall perspective view of the fixing roller assembly showing the state where all of the components are assembled. FIG. 10 is a sectional view of FIG. 9 taken along an X-X line.

At opposite end portions of the fixing roller 30*b*, a pair of the first engaging holes 34 and the second engaging hole 35 are formed respectively. This point is the same as the fixing roller 30 of the first embodiment. Further, a proper part of an end portion of the fixing roller 30*b* at near side in FIG. 8 (a point symmetric position with respect to the second engaging hole 35 in the present embodiment), a key portion 36 is formed. The key portion 36 is formed by recessing an end portion of the fixing roller 30*b* radially inwardly so as to have a substantially flat surface. Also, the ring gear 50 is formed with a fitting hole having a flat portion 52 agreeing with the key portion 36. The key portion 36 enables the ring gear 50 placed thereon to be rotated coaxially with the fixing roller 30*b* about an axis. In an end portion of the fixing roller 30*b* at a far side in FIG. 8A, the key portion 36 is not formed since it is not necessary to mount the ring gear 50.

On a near end portion of the fixing roller 30*b*, the annular heat-insulating member 40, the ring gear 50, the bearing 60 and the C-shaped stopper 70 are mounted. On the other hand, on the opposite end portion, the annular heat-insulating member 40, the bearing 60 and the C-shaped stopper 70 are placed (refer to FIG. 10). These points are also the same as the fixing roller 30 of the first embodiment.

The C-shaped stopper 70 used in the fourth embodiment is substantially the same as that used in the first embodiment. Namely, the C-shaped stopper 70 is formed by curving a wire member into a C-shape so as to have a shape of an arc having a curvature center angle of substantially 240 degrees and includes a pair of end engaging portions 71 formed by bending opposite ends of the wire member toward a curvature center of the curved wire member and an intermediate engaging portion 72 formed by bending an intermediate part toward a curvature center into a V-shape.

A pair of the end engaging portions 71 corresponds to a pair of the first engaging holes 34 of the fixing roller 30*b*, and the intermediate engaging portion 72 corresponds to the second engaging hole 35 of the fixing roller 30*b*. The annular heat-insulating member 40 and the bearing 60 are mounted on the fixing roller 30. Further, in the state where the ring gear 50 is mounted at slightly inner portion from the first and second engaging holes 34, 35 of the fixing roller 30, pair of the end engaging portions 71 are placed in a pair of the first engaging holes 34 of the fixing roller 30*b*. Further, by placing the intermediate engaging portion 72 into the second engaging hole 35, the C-shaped stopper 70 is attached to the fixing roller 30*b* and supported at three supporting. Consequently, the ring gear 50, the annular heat-insulating member 40 and the bearing 60 are prevented from moving out of the fixing roller 30.

According to the fixing roller assembly of the fourth embodiment, the C-shaped stopper 70 is attached to the fixing roller 30*b* with three supporting points. Consequently, attaching condition of the C-shaped stopper 70 with respect to the fixing roller 30 is stabilized. Further, on the fixing roller 30, only the three engaging holes (a pair of the first engaging holes 34 and the second engaging hole 35) for attaching the C-shamed stopper 70 and one key portion 36 for mounting the ring gear 50 are formed. Therefore, even if the fixing roller 30 has a thin wall, the fixing roller 30 can be accommodated.

Figure 11A:
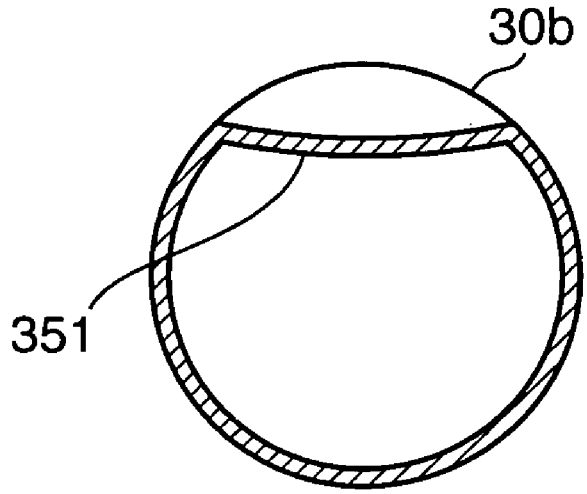
FIGS. 11A and 11B are sectional views showing other forms of the key portion.
Figure 11B:
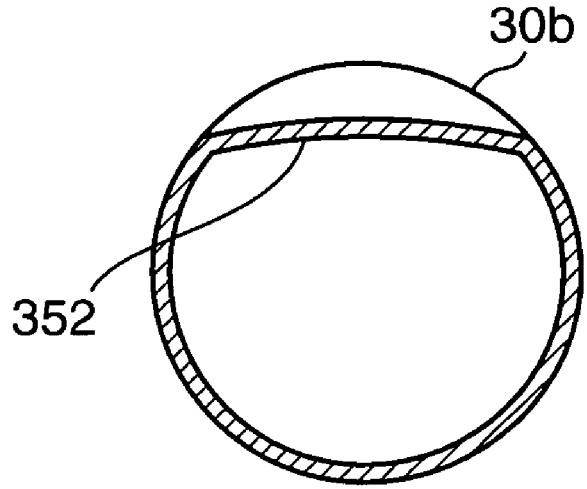

An example of the key portion 36 having a straight line cross-section is shown in the embodiment. However, the key portion 36 may have a shape other than the straight line. FIGS. 11A, 11B is a sectional view showing other forms of the key portion. FIG. 11A shows a key portion 351 having an inwardly curved surface. FIG. 11B shows a key portion 352 having an outwardly curved surface. Especially, the key portion 351 shown in FIG. 11A a substantially flat surface of the key portion 351 is formed to be curved inwardly. Accordingly, in the case where a rotational force about an axis is applied between the ring gear 50 and the fixing roller 30, an end portion of the key portion 351 receives inward force of the fixing roller 30 from the ring gear 50 (namely, a distortion moves toward radially inner part), the ring gear 50 may be easily mounted on the fixing roller 30. On the other hand, a rotational force is transmitted between the fixing roller 30 and the ring gear 50 while being difficult to be deformed.

As described above, the fixing device 20 according to the present invention includes the fixing roller 30, 30*a*, 30*b* and the pressing roller 80. The fixing roller 30, 30*a*, 30*b* carries the heat generating body 24 such as a halogen lamp and the like as a heating source. The pressing roller 80 has a peripheral surface being pressingly coming in contact with a peripheral surface of the fixing roller 30, 30*a*, 30*b* and is rotatable about a center axis extending in the same direction as the axis of the fixing roller 30, 30*a*, 30*b*. A recording sheet P is supplied to a nip portion N formed between the fixing roller 30, 30*a*, 30*b* and the pressing roller 80 so that a fixing process is applied to the recording sheet P on which a toner image is transferred. Namely, the recording sheet P is supplied to the nip portion N and applied with heat by the fixing roller 30, 30*a*, 30*b* interiorly provided with a heating source to fix a toner image while being conveyed. Then, the recording sheet P is discharged from the nip portion N. Consequently, the fixing process is completed.

On the fixing roller 30, 30*a*, 30*b*, at least the annular heat-insulating member 40 and the bearing 60 are mounted. The annular heat-insulating member 40 is coaxially mounted on the fixing roller 30, 30*a*, 30*b*. The bearing 60 is coaxially placed on the annular heat-insulating member 40. Thus, by making a predetermined frame support the bearing 60, the fixing roller 30, 30*a*, 30*b* can be smoothly rotated through the bearing 60. Further, the annular heat-insulating member 40 mounted between the fixing roller 30, 30*a*, 30*b* and the bearing 60 suppresses a transmission of heat from the fixing roller to the bearing 60. Consequently, burning of the bearing 60 due to an excessive heating is prevented.

Then, the C-shaped stopper 70, 70*a* for preventing the annular heat-insulating member 40 from moving out is attached to the fixing roller 30, 30*a*, 30*b*. The C-shaped stopper 70, 70*a* is attached on a peripheral surface of the fixing roller 30, 30*a* with three points support. Accordingly, as compared to a conventional C-shaped stopper attached to the fixing roller with two-point support, attaching condition of the C-shaped stopper 70, 70*a* with respect to the fixing roller 30, 30*a* is extremely stabled. Thus, jouncing of the fixing roller 30, 30*a*, 30*b* rotating for performing a fixing process to the recording sheet P and a disadvantage that a fixing process is not stably performed to the recording sheet P due to the jouncing of the fixing roller 30, 30*a*, 30*b* can be surely prevented.

Further, the C-shaped stopper 70, 70*a* includes a pair of end engaging portions 71 protruding from opposite ends of the C-shaped stopper and facing each other in the opposite directions, and an intermediate engaging portion 72, 72*a* protruding inwardly from substantially an intermediate part of the C-shaped stopper. On the other hand, the fixing roller 30, 30*a*, 30*b* includes a pair of first engaging holes 31, 34 into which the pair of end engaging portions 71 are respectively placed and a second engaging hole 32, 34 into which the intermediate engaging portion 72, 72*a* is placed. The C-shaped stopper 70, 70*a* is deformed in a predetermined manner, and the pair of end engaging portions 71 are respectively placed into the corresponding first engaging holes 31, 34 of the fixing roller 30, 30*a*, 30*b*. Then, the intermediate engaging hole 72, 72*a* is placed into the second engaging hole 32, 35. Accordingly, the elastically deformed C-shaped stopper 70, 70*a* is restored to the original state so that the C-shaped stopper 70, 70*a* is easily and securely attached to the fixing roller 30, 30*a*, 30*b*.

Further, the fixing roller 30*a* according to the second and third embodiments is formed with a constricted slit 321 extending from the second engaging hole 32 to an end edge of the fixing roller 30*a*. A leading end side of the constricted slit 321 is an open end which is open toward outside. In the state where the pair of end engaging portions 71 of the C-shaped stopper 70, 70*a* are respectively placed into the corresponding first engaging holes 31, the C-shaped stopper 70, 70*a* is rotated about the end engaging portions 71 toward the second engaging hole 32. Accordingly, the intermediate engaging portion 72, 72*a* can be placed into the second engaging hole 32 through the open end. Thus, a mountability of the C-shaped stopper 70, 70*a* with respect to the fixing roller 30*a* can be improved.

The open end of the constricted slit 321 has a width smaller than the second engaging hole 32, and the intermediate engaging portion 72, 72*a* is passable through the open end in a state of being elastically deformed. In the state where the pair of end engaging portions 71 of the C-shaped stopper 70, 70*a* are respectively placed into the first engaging holes 31 of the fixing roller 30*a*, the intermediate engaging portion 72, 72*a* is elastically deformed so as to pass through the open end, and the C-shaped stopper 70, 70*a* is rotated about the end engaging portions 71 toward the second engaging hole 32. Accordingly, the intermediate engaging portion 72, 72*a* is placed into the second engaging hole 32 through the open end. Thereafter, the elastically deformed intermediate engaging portion 72, 72*a* is restored into the original state. Consequently, the intermediate engaging portion 72, 72*a* is engaged with the opposite end portions facing each other of the second engaging hole 32 and prevented from moving out.

As described above, the open end is set to have a width smaller than the second engaging hole 32, and the intermediate engaging portion 72, 72*a* is formed so as to be passable through the open end by being elastically deformed. Consequently, a mountability of the C-shaped stopper 70, 70*a* with respect to the fixing roller 30*a* is improved, and a secured mounting state of the C-shaped stopper 70, 70*a* with respect to the second engaging hole 32 can be obtained.

In this case, the intermediate engaging portion 72, 72*a* is formed to have a V-shape (the second embodiment) or an inversed Ω-shape (the third embodiment). Consequently, the intermediate engaging portion 72, 72*a* can be easily deformed elastically when the C-shaped stopper 70, 70*a* is attached to the fixing roller 30*a*.

Further, the fixing roller 30*b* according to the fourth embodiment includes a key portion 36 in an end thereof, and the key portion is recessed radially inwardly so as to have a substantially flat surface. Therefore, as compared to a conventional fixing roller having a key portion formed by cutting a part of a cylinder having a thick wall, the key portion 36 can be easily formed by one pressing process. This contributes to a decrease in processing costs. Furthermore, by an elastic deformation made by the pressing process, the key portion 36 having no cutting line with respect to other parts can be formed. Accordingly, a portion where the key portion 36 of the fixing roller 30*b* does not become weak structurally, and a disadvantage that the key portion 36 becomes structurally weak can be avoided even if the fixing roller 30 has a thin wall. Consequently, the key portion 36 can be accommodated to a partial load toward a rotational direction of the fixing roller 30*b*.

The key portion 36 is preferably formed so as to have an arc surface curving radially inwardly, as shown in FIG. 11A. In other words, the end portion of the fixing roller 30*b* has a substantially D-shaped section. Thus, if the ring gear 50 is rotated about a shaft in the state where the ring gear 50 including a fitting hole having a flat portion 52 agreeing with the key portion 36 is coaxially placed on an end portion of the fixing roller 30*b*, rotational force of the ring gear 50 is applied to an end portion in a rotational direction. Consequently, an end portion of the key portion 36 receives a force which is applied toward a radially inner side of the fixing roller 30*b*. Rotation of the ring gear 50 is transmitted to the fixing roller 30 in the state of being difficult to be deformed.

As described above, by setting the end portion of the fixing roller 30*b* to be curved to form the key portion 36, rotational force of the ring gear 50 about an axis center is transmitted to the fixing roller 30 in the state where the force is applied so as not to damage the key portion 36. Accordingly, even if the fixing roller 30*b* has a thin wall, a rotational force of the ring gear 50 is securely transmitted to the fixing roller 30*b*.

The present invention is not limited to the above-described embodiments, but includes the following.

In the embodiment above, the printer 10 is described as an example of the image forming apparatus to which the fixing device 20 is applied. However, in the present invention, the image forming apparatus is not limited to the printer 10 but may be a copying machine which transfers read image information to a recording sheet P or a facsimile machine which prints out electrically transmitted image information.

In the embodiment above, the ring gear 50 is directly mounted on the fixing roller 30, 30*a*, 30*b*. Instead, the ring gear 50 may be mounted on the fixing roller 30, 30*a*, 30*b* through the annular heat-insulating member 40.

In the embodiment above, the pair of first engaging holes 31, 34 and one second engaging hole 32, 35 are respectively formed at even intervals at positions along a rotational direction of the fixing roller 30, 30*a*, 30*b*. However, the present invention is not limited to forming the holes at even intervals. Positions of the holes may be determined desirably according to a situation.

In the embodiment above, the C-shaped stopper 70, 70*a* is elastically deformed and attached to the fixing roller 30, 30*a*, 30*b*. However, in the case of the fixing roller 30*a* according to the second embodiment, the intermediate engaging portion 72, 72*a* may be replaced by a mere protrusion which is not elastically deformed. In this case, the protrusion is placed in the second engaging hole 32 through the constricted slit 321 utilizing the feature that the pair of first engaging holes 31 are elongate holes, and then the C-shaped stopper is rotated about an axis of the cylinder. Accordingly, the protrusion interferes with and edge portion of the second engaging hole 32. Consequently, the C-shaped stopper is prevented from moving out.

In the embodiment described above, the C-shaped stopper 70, 70*a* is attached to the fixing roller 30, 30*a*, 30*b* at three supporting points. However, the present invention is not limited to that the C-shaped stopper 70, 70*a* are attached to the fixing roller 30, 30*a*, 30*b* at three supporting points but may be attached to the fixing roller 30, 30*a*, 30*b* at four or more supporting points.

This application is based on patent application Nos. 2005-240742 and 2005-240743 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device comprising:

a heating source adapted for performing fixing of a toner image onto a recording medium by heat;

a fixing roller including a thin-wall cylinder rotatable about an axis thereof and carrying the heat source therein, the recording medium being placed on a peripheral surface of the cylinder;

an annular heat-insulating member coaxially mounted on an outside surface of the fixing roller; and a C-shaped stopper attached to the peripheral surface of the fixing roller for preventing the annular heat-insulating member from moving out of the fixing roller, the C-shaped stopper including at least three engaging portions.

2. A fixing device according to claim 1, wherein the C-shaped stopper includes a pair of end engaging portions protruding from opposite ends of the C-shaped stopper and facing each other in the opposite directions, and an intermediate engaging portion protruding inwardly from substantially an intermediate part of the C-shaped stopper, and the fixing roller includes a pair of first engaging holes into which the pair of end engaging portions are respectively placed and a second engaging hole into which the intermediate engaging portion is placed.

3. A fixing device according to claim 2, wherein the intermediate engaging portion of the C-shaped stopper has a V-shape or an inverted Ω-shape.

4. A fixing device according to claim 3, wherein the C-shaped stopper is formed by curving a wire member into a C-shape, and bending opposite ends of the wire member toward a curvature center of the curved wire member to form a pair of end engaging portions, and bending substantially an intermediate part of the wire member toward the curvature center into a V-shape or an inverted Ω-shape to form an intermediate engaging portion.

5. A fixing device according to claim 2, wherein the fixing roller includes a center angle between the pair of the first engaging holes is substantially 120 degrees and a center angle between the second engaging hole and each first engaging hole is substantially 120 degrees, and the C-shaped stopper has the shape of an arc having a curvature center angle of substantially 240 degrees.

6. A fixing device according to claim 2, wherein the fixing roller is formed with an opening extending from the second engaging hole to an end edge of the fixing roller.

7. A fixing device according to claim 6, wherein the opening has a width smaller than the second engaging hole, and the intermediate engaging portion of the C-shaped stopper is passable through the opening in a state of being elastically deformed.

8. A fixing device according to claim 7, wherein the C-shaped stopper is formed by curving a wire member into a C-shape, and bending opposite ends of the wire member toward a curvature center of the curved wire member to form a pair of end engaging portions, and bending substantially an intermediate part of the wire member toward the curvature center into a V-shape to form an intermediate engaging portion;

the C-shaped stopper is rotatable about the end engaging portions in a state where the end engaging portions are placed in the respective first engaging holes; and the intermediate engaging portion having the V-shape is passable through the opening while being narrowed.

9. A fixing device according to claim 7, wherein the C-shaped stopper is formed by curving a wire member into a C-shape, and bending opposite ends of the wire member toward a curvature center of the curved wire member to form a pair of end engaging portions, and bending substantially an intermediate part of the wire member toward the curvature center into an inverted D-shape to form an intermediate engaging portion;

the C-shaped stopper is rotatable about the end engaging portions in a state where the end engaging portions are placed in the respective first engaging holes; and the intermediate engaging portion having the inverted Ω-shape is passable through the opening while a constricted part of the inverted Ω-shaped intermediate engaging portion is narrowed.

10. A fixing device according to claim 1, wherein the fixing roller includes a key portion in an end portion thereof, the key portion having a substantially flat surface which is inwardly recessed.

11. A fixing device according to claim 10, wherein the end portion of the fixing roller has a substantially D-shaped section.

12. A fixing device according to claim 1, wherein the fixing roller includes a key portion in an end portion thereof, the key portion having an arc surface which is inwardly curved.

13. A fixing device according to claim 1, further comprising a bearing which supports the fixing roller rotatably about the axis by way of the annular heat-insulating member.

14. A fixing device according to claim 1, further comprising a ring gear mounted on the fixing roller, wherein the C-shaped stopper is adapted for preventing the ring gear and the annular heat-insulating member from moving out of the fixing roller.

15. An image forming apparatus comprising:

an apparatus main body;

a transferring portion adapted for transferring a toner image to a predetermined recording medium; and a fixing portion adapted for performing a fixing of a toner image onto to the recording medium on which a toner image is transferred in the transferring portion, wherein the fixing portion includes:

a heating source adapted for performing fixing of a toner image onto a recording medium by heat;

a fixing roller carrying the heating source and constructed by a thin-wall cylinder rotatable about an axis thereof, the recording medium being placed on a peripheral surface of the fixing roller;

an annular heat-insulating member coaxially mounted on an outside surface of the fixing roller; and a C-shaped stopper including at least three engaging portions and attached to the peripheral surface of the fixing roller, the C-shaped stopper ring being adapted for preventing the annular heat-insulating member from moving out of the fixing roller.

* * * * *